US005611317A

United States Patent [19]

Peters et al.

[11] Patent Number: 5,611,317

[45] Date of Patent: Mar. 18, 1997

[54] OPEN NOZZLE FUEL INJECTOR HAVING DRIVE TRAIN WEAR COMPENSATION

[75] Inventors: Lester L. Peters; Julius P. Perr; Yul J. Tarr, all of Columbus, Ind.

[73] Assignee: Cummins Engine Company, Inc., Columbus, Ind.

[21] Appl. No.: 513,201

[22] Filed: Aug. 9, 1995

[51] Int. Cl.[6] ..... F02M 37/04

[52] U.S. Cl. ..... 123/501; 123/446; 239/95

[58] Field of Search ..... 123/446, 447, 123/467, 501, 506; 239/95, 584, 88

[56] References Cited

U.S. PATENT DOCUMENTS

| | | | |
|---|---|---|---|
| 4,410,137 | 10/1983 | Perr | 239/95 |
| 4,410,138 | 10/1983 | Peters et al. | 239/95 |
| 4,420,116 | 12/1983 | Warlick | 239/95 |
| 4,441,654 | 4/1984 | Peters | 239/89 |
| 4,951,631 | 8/1990 | Eckert | 123/446 |
| 5,011,079 | 4/1991 | Perr | 239/95 |
| 5,040,511 | 8/1991 | Eckert | 123/501 |
| 5,056,488 | 10/1991 | Eckert | 123/496 |
| 5,076,240 | 12/1991 | Perr | 123/501 |
| 5,209,403 | 5/1993 | Tarr et al. | 239/91 |
| 5,275,337 | 1/1994 | Kolarik et al. | 239/91 |
| 5,299,738 | 4/1994 | Genter et al. | 123/467 |
| 5,323,964 | 6/1994 | Doszpoly et al. | 239/95 |

*Primary Examiner*—Thomas N. Moulis

*Attorney, Agent, or Firm*—Sixbey, Friedman, Leedom & Ferguson; Charles M. Leedom, Jr.; Tim L. Brackett, Jr.

[57] ABSTRACT

A cam operated open nozzle fuel injector is provided comprising a reciprocating plunger assembly including an outer plunger, an inner plunger and a variable volume timing chamber located between the plungers. A hold down force generating means includes a cam having a hold down cam or ramp portion for maintaining the inner plunger in an innermost position against the inner end of the injector body with a sufficient hold down force during each hold down period throughout injector operation independently of injector train wear. The hold down cam portion operates to move the outer plunger inwardly towards the inner plunger throughout a substantial portion of the hold down period. The hold down cam portion functions to compensate for fuel drainage from the timing chamber so as to maintain a predetermined pressure in the timing chamber corresponding to a desired hold down force. The hold down force generating device is capable of maintaining timing fluid in the timing chamber throughout the hold down period and may include a timing chamber drain regulating valve for controlling the drainage of fluid from the timing chamber.

20 Claims, 4 Drawing Sheets

START OF METERING

END OF METERING

END OF INJECTION

START OF PLUNGER RETRACTION

OPEN NOZZLE FUEL INJECTOR HAVING DRIVE TRAIN WEAR COMPENSATION

TECHNICAL FIELD

The present invention relates to unit fuel injectors, and in particular, those of the type having an open nozzle and a reciprocating injection plunger that is mechanically actuated by an engine camshaft.

BACKGROUND

Heretofore, various types of fuel injectors and fuel injection systems have been known to effectively inject fuel into an engine cylinder of an internal combustion engine. Of the many types of fuel injection systems, the present invention is directed to unit fuel injectors, wherein a unit fuel injector is associated with each cylinder of an internal combustion engine and each unit injector includes a pump plunger driven by an associated drive train for pressurizing low pressure fuel in the injector to a high pressure and injecting fuel into each cylinder on a cyclic basis. Normally, the drive train of each injector is driven from a rotary mounted camshaft operatively driven from the engine crankshaft for synchronously controlling each unit injector independently and in accordance with the engine firing order.

One such unit fuel injector is an "open nozzle" type fuel injector wherein fuel is metered into a metering chamber open to the engine cylinder by way of the injector orifices. The injector plunger is typically positioned in the bore forming the metering chamber so that inward movement of the plunger causes compression and injection of the metered fuel.

As the need for higher engine efficiency and pollution abatement have increased, it has become increasingly evident that some economical means must be provided to vary injector timing in response to changing engine operating conditions. U.S. Pat. Nos. 4,420,116; 5,026,240; 5,209,403; 5,275,337; and 5,323,964 all provide examples of open nozzle injectors capable of varying the timing of injection. In particular, these patents disclose the use of a collapsible hydraulic link to selectively change the effective length of the cam operated fuel injector plunger. These injectors include a multi-piece plunger between which is formed a variable length timing chamber which expands and collapses during each injection cycle to control the length of the hydraulic link.

In the above mentioned open nozzle injectors, the end of fuel injection is caused by the abutment of the inner end of the plunger against the inner surface of the nozzle housing adjacent the orifices. A sharp end to injection, without subsequent secondary injection, is desired in order to minimize smoke and unburned hydrocarbons in the exhaust. Secondary injection may be minimized by pressing the plunger against a seat in the injector cup adjacent the orifices with sufficient force to expel virtually all the remaining fuel from the metering chamber. Also, the plunger must be held tightly against its seat with a sufficient hold down force necessary to prevent exhaust gases from entering the injector during the exhaust stroke of the engine. Such blow-back gases cause undesirable fouling and wear in the injector and adversely affect subsequent metering and injection.

The hold down force is applied to the plunger by the injector drive train. At the end of injection, with the inner plunger of the injectors disclosed in the aforementioned patents, in the innermost position against the cup, the timing chamber fully collapses until the outer plunger abuts the inner plunger. The magnitude of the hold down force on the inner plunger is dependent on the positioning and setting of each of the components of the drive train, including the injector plungers, drive links, cam, etc., relative to one another. Therefore, use of these injectors requires the injector train for each injector to be precisely set upon installation to create the proper hold down force thus undesirably adding to installation time and costs. Also, the particular setting of each injector necessary to obtain the desired force is likely to be different for each injector since the size tolerances of each component will vary. Moreover, throughout operation of the injector, wear between the drive train components causes the hold down force to decrease as the clearances between components becomes greater. Consequently, these open nozzle injectors require costly periodic adjustments to the drive train to reset the hold down force to compensate for injector train wear.

U.S. Pat. Nos. 4,410,137; 4,410,138; and 4,420,116, commonly assigned to the assignee of the present application, each disclose open nozzle unit fuel injectors having a variable volume timing chamber which collapses after the inner plunger reaches the innermost position (FIG. 3). This design creates a minimal hydraulic link which automatically compensates for wear in the injector actuation train. However, the minimal hydraulic link is only formed for a very short period during the beginning of the hold down period after the inner plunger has reached the cup. The timing chamber collapses soon thereafter at the beginning of the hold down period causing the outer plunger to contact the inner plunger. The outer base circle of the cam, having a constant diameter, is supposed to then operate to hold the outer plunger against the inner plunger with sufficient force. However, as discussed hereinabove, the load induced by the cam in this injector will vary with injector train wear.

Consequently, there is a need for an open nozzle fuel injector assembly capable of maintaining an optimum hold down force on the injector plunger throughout operation of the injector by compensating for injector actuator train wear without the need for expensive and time consuming injector train load setting and adjustment procedures.

SUMMARY OF THE INVENTION

It is an object of the present invention, therefore, to overcome the disadvantages of the prior art and to provide an open nozzle fuel injector assembly which automatically compensates for injector drive train wear.

It is another object of the present invention to provide an open nozzle fuel injector assembly which avoids the need for expensive and time consuming injector train load setting and adjustment procedure.

It is yet another object of the present invention to provide an open nozzle fuel injector assembly which maintains an optimum hold down force on an inner injector plunger throughout operation of the injector.

It is a further object of the present invention to provide an open nozzle fuel injector assembly and injector drive train which provides a sharp end to injection, without subsequent secondary injections, thereby minimizing smoke and unburned hydrocarbons.

It is still a further object of the present invention to provide open nozzle fuel injector assembly capable of maintaining a hydraulic link between the inner and outer plungers of the injector while simultaneously creating a sufficient hold down force on the inner plunger.

Still another object of the present invention is to provide an open nozzle fuel injector assembly capable of automatically compensating for injector drive train wear while also creating a sufficient hold down force necessary to prevent exhaust gases in the engine cylinder from entering the injector.

These and other objects are achieved by providing a cam operated open nozzle fuel injector for injecting fuel during successive of injection cycles into a combustion chamber of an internal combustion engine, comprising an injector body containing a central bore and an injector orifice at an inner end of the injector body, a reciprocating plunger assembly including an outer plunger and an inner plunger mounted within the central bore, a variable volume timing chamber located between the upper plunger and the inner end of the injector body, and a cam operatively connected to the reciprocating plunger assembly for imparting inward movement to the inner and outer plungers. The cam includes a hold down cam portion for maintaining the inner plunger in an innermost position against the inner end of the injector body to define a hold down period wherein the hold down cam portion operates to move the outer plunger inwardly towards the inner plunger throughout a substantial portion of the hold down period. The timing chamber may communicate for a portion of each injection cycle with a source of timing fluid and the assembly may also include a timing chamber drain passage communicating with the timing chamber for draining fluid from the timing chamber. The assembly may also include a timing chamber drain regulating valve for controlling the drainage of fluid from the timing chamber through the drain passage. The hold down cam portion may function to compensate for the controlled fuel drainage by the regulator valve so as to maintain a predetermined hold down force on the inner plunger. The drain regulator valve may include a pressure actuated valve for opening and closing the drain passage in response to a fluid pressure in the timing chamber. The pressure actuated valve may include a band-shaped resilient valve member. Also, the reciprocating plunger assembly may include an intermediate plunger for reciprocating movement within the central bore between the outer and inner plungers to form the timing chamber. In addition, a variable volume injection chamber may be formed between the inner plunger and the inner end of the injector body for receiving fuel for injection.

The open nozzle fuel injector assembly of the present invention may include a hold down force generating device for creating a hold down force on the inner plunger tending to hold the inner plunger in an advanced position against the inner end following termination of injection during each injection cycle. The hold down force generating device is capable of maintaining timing fluid in the timing chamber throughout the hold down period so as to create a hydraulic hold down link between the outer and inner plungers wherein the link is maintained throughout the hold down period. The assembly includes an injector drive train for moving the reciprocating plunger assembly between advanced and retracted positions, which is subject to wear, like the reciprocating plunger assembly, during operation of the injector which tends to increase the size of the hold down link. The hold down force generating device functions to maintain the hold down force at a predetermined level throughout injector operation. The hold down force generating device may include the above noted cam which may be operatively connected to the reciprocating plunger assembly for imparting inward movement to the outer and inner plunger. In this manner, the hold down portion of the cam maintains the inner plunger in the advanced position.

DESCRIPTION OF THE PREFERRED EMBODIMENT

Throughout this application, the words "inward", "innermost", "outward" and "outermost" will correspond to the directions, respectively toward and away from the point at which fuel from an injector is actually injected into the combustion chamber of the engine. The words "outer" and "inner" will refer to the portions of the injector assembly which are, respectively, farthest away and closest to the engine cylinder when the injector is operatively mounted on the engine.

Figure 1:
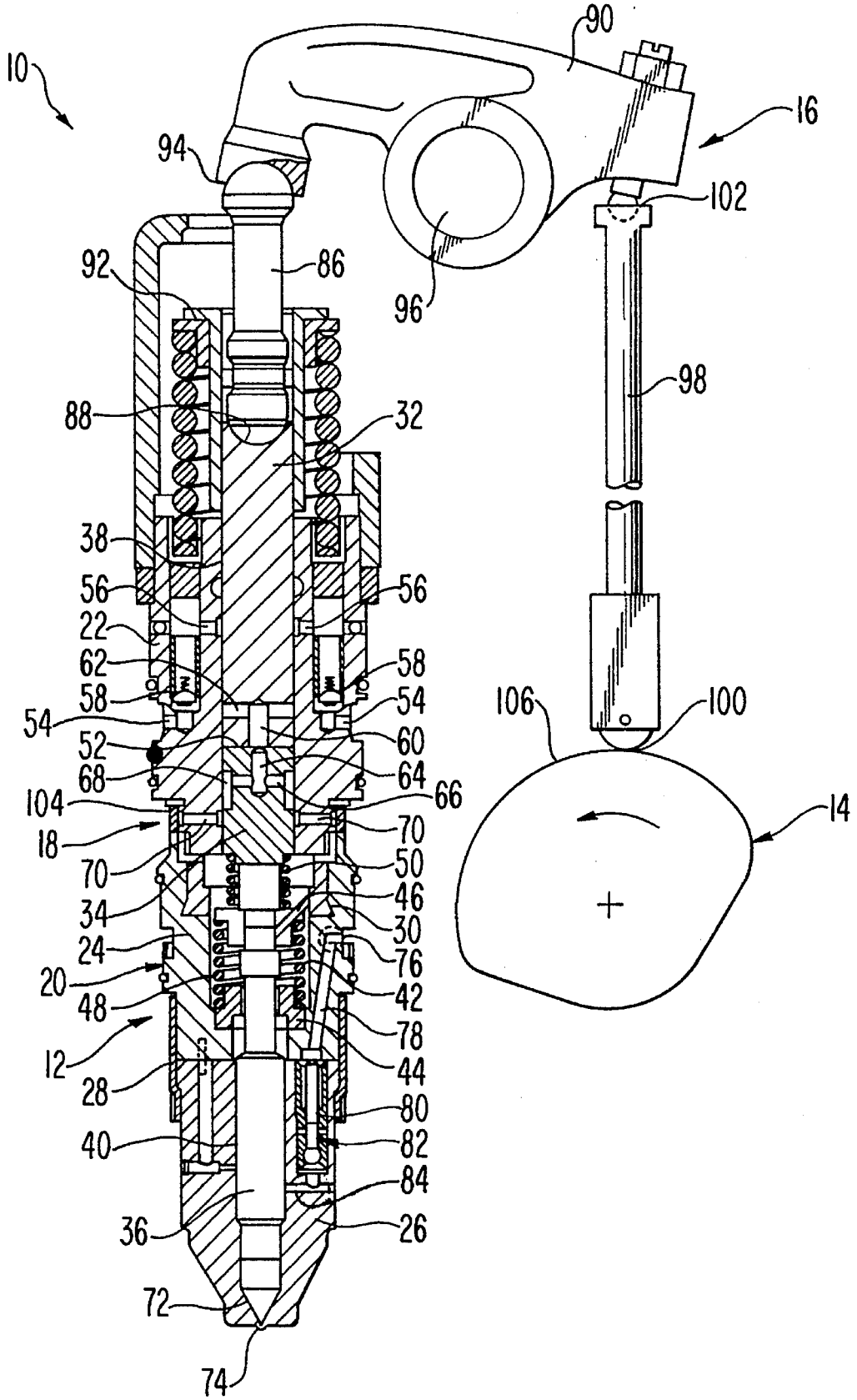
FIG. 1 is a schematic illustration of a preferred open nozzle high pressure unit fuel injector designed in accordance with the present invention and the associated drive train for operating the unit injector.

Referring to FIG. 1, there is shown an open nozzle unit injector assembly of the present invention generally indicated at 10 which generally includes an open nozzle unit injector 12, an improved cam 14 and injector cam drive train 16 for transforming the rotational movement of the cam 14 into reciprocating movement for operating open nozzle injector 12 as determined by the cam profile. Open nozzle injector 12 includes a timing spill regulator valve 18 which operates in conjunction with improved cam 14 of the present invention to compensate for wear between the various movable joints connecting the various components of injector drive train 16 to cam 14 and the plungers of injector 12 so as to maintain a desired hold down force on the injector plungers necessary to permit effective fuel injection and engine operation without complex injector installation and maintenance procedures.

Open nozzle injector 12 represents one version of an open nozzle injector which may be used in accordance with the present invention. Open nozzle injector 12 includes an injector body 20 formed from an outer barrel 22, and inner barrel 24 and an injector cup 26. The injector cup 26 and inner barrel 24 are held together in a compressive abutting relationship by a retaining sleeve 28. The outer end of retaining sleeve 28 contains internal threads for engaging corresponding external threads on the lower end of inner barrel 24 to permit these elements to be held together by simple relative rotation of retaining sleeve 28 with respect to inner barrel 24. The inner end of outer barrel 22 contains external threads for engaging corresponding threads formed on the inside surface of a recess 30 formed in the outer end of inner barrel 24.

Fuel injector 12 includes an outer plunger 32, intermediate plunger 34 and an inner plunger 36. Both outer plunger 32 and intermediate plunger 34 are mounted for reciprocal movement in a plunger cavity 38 formed in outer barrel 22. Inner plunger 36 is likewise mounted for reciprocal movement in a plunger cavity 40 formed in injector cup 26. The outer end of inner plunger 36 extends through a central cavity 42 formed in inner barrel 24. Inner and outer spring guides 44, 46 are positioned in central cavity 42 and arranged so as to cause a first biasing spring 48 to bias inner plunger 36 outwardly towards intermediate plunger 34. A second biasing spring 50 is mounted at the outer end of central cavity 42 for biasing intermediate plunger 34 toward outer plunger 32.

The innermost end of outer plunger 32 together with the outermost end of intermediate plunger 34 form a timing chamber 52 for receiving timing fluid. A pair of timing fluid inlet passages 54 formed in outer barrel 22 communicate with a respective pair of delivery ports 56 via timing fluid check valve assemblies 58 which prevent the flow of timing fluid from timing chamber 52. The outer plunger 32 includes an axial passage 60 communicating with timing chamber 52 and extending outwardly to connect with a diametrically extending passage 62 formed in outer plunger 32. During a portion of the injection cycle, with outer plunger 32 in its outermost position, delivery passage 62 connects with delivery ports 56 to permit timing fluid to be metered into timing chamber 52. As is well known, the amount of timing fluid metered into timing chamber 52 determines the size of the hydraulic link formed by timing chamber 52 which determines the degree of advancement and retardation of the timing of injection.

Intermediate plunger 34 includes an axial passage 64 communicating with timing chamber 52 and extending to communicate with a diametrical passage 66. An annular groove 68 formed in intermediate plunger 34 communicates with diametrical passage 66. Outer barrel 22 includes a pair of timing fluid drain passages 70 extending radially outward from plunger cavity 38. At the end of the injection event, when intermediate plunger 34 and inner plunger 36 reach their innermost positions, annular groove 68 moves into communication with timing chamber drain passages 70 to permit control drainage from timing chamber 52 via timing spill regulator valve 18.

Open nozzle injector 12 also includes a metering chamber 72 formed in plunger cavity 40 between inner plunger 36 and the inner end of injector cup 26. Fuel metered into chamber 72 is forced from chamber 72 by inner plunger 36 through injector orifices 74 formed in the inner end of cup 26. Fuel for injection is supplied to chamber 72 via a fuel inlet port 76 formed in inner barrel 24. Fuel from port 76 flows through a delivery passage 78 extending inwardly through inner barrel 24 which communicates at its inner end with an axial passage 80 formed in injector cup 26. A check valve assembly 82 is positioned in axial passage 80 to permit the flow of fuel into metering chamber 72 while preventing back flow from metering chamber 72. The inner end of axial passage 80 communicates with a radial passage 84 which delivers fuel to metering chamber 72 during a metering period when the inner plunger moves outwardly a sufficient distance to uncover passage 84.

It should be noted that although FIG. 1 illustrates a preferred version of open nozzle injector for use with the present invention, practically any type of open nozzle injector may be adapted for use with the present invention so long as the open nozzle injector includes a multi-plunger arrangement having a variable volume timing chamber, and capable of receiving, or operating in conjunction with a timing spill regulating valve.

Injector drive train 16 includes a link 86 which abuts the outer end of outer plunger 32 at 88 and connects at an opposite end to a rocker arm 90. A coupling 92 secured to outer plunger 32 is biased outwardly by a spring 94 to maintain the outer end of link 86 in abutment with rocker arm 90 at connection 94. Rocker arm 90 is pivotally mounted on a shaft 96 to transform the rotary motion of cam 14 into reciprocating motion of link 86. A push rod 98 may be connected at one end to cam 14 as indicated at 100 and at an opposite end to rocker arm 90 indicated at 102. In this manner, push rod 98 follows the profile of cam 14 as cam 14 rotates to thereby pivot rocker arm 90 resulting in movement of the injector plungers. Although FIG. 1 discloses a preferred injector drive train, other injector drive trains, such as an overhead cam arrangement which avoids the need for a push rod and/or a rocker arm could be used so long as the cam is designed in accordance with the present invention.

During operation of a conventional open nozzle injector assembly including a conventional cam, timing fluid and metering fuel are metered into respective timing and fuel metering chambers while the respective outer and inner plungers are moving towards or already in their outermost position. As the conventional cam continues to rotate, the plungers are driven inwardly creating a hydraulic link in the timing chamber which has a predetermined link corresponding to a desired advancement or retardation of injection. Further inward movement of the plungers forces the inner plungers 36 inwardly forcing fuel in the metering chamber outwardly through the injection orifices into the engine cylinder. The end of injection is caused by the abutment of the inner end of the inner plunger against the inner surface of the injector cup. With the conventional open nozzle injector, at the end of injection, the timing chamber is connected to a drain causing the timing chamber to fully collapse until the outer plunger abuts the inner plunger. The conventional cam is designed at this point in the cycle with a substantially constant outer base circle diameter which holds the outer plunger in abutment against the inner plunger so as to create a desired hold down force for holding the inner plunger against the injector cup. This hold down force insures that the inner plunger forces virtually all the remaining fuel from the metering chamber at the end of injection. The hold down force is maintained throughout the exhaust stroke of the engine to prevent exhaust gases from entering the injector and adversely affecting subsequent metering and injection. In order to continue to prevent the adverse effects of exhaust gas into the injector, the inner plunger must be held tightly against its seat in the cup for a portion of the power stroke and the entire exhaust stroke of the engine. Therefore, it is extremely important to insure a sufficient hold down force is maintained against the inner plunger. However, throughout operation of an open nozzle injector and injector drive train, the injector plungers and drive train components are subject to wear at the points of connection. This drive train wear creates play between the components and gradually decreases the hold down force thus requiring time consuming and costly maintenance and load resetting procedures. Moreover, the injector and drive train must be initially set to accurately cream the necessary hold down force.

The present invention solves these problems by automatically compensating for injector plunger and drive train wear throughout the operation of the injector while avoiding the initial set up procedure required by conventional assemblies to set the hold down force. The present invention uses a hold down force generating device which includes a specially designed cam 14 and a timing spill regulator valve 18 to maintain the pressure in the timing chamber at a predetermined level necessary to create the desired hold down force while preventing outer plunger 32 from contacting intermediate plunger 34. By maintaining fluid in the timing chamber throughout the hold down period, during which a hold down force is applied to inner plunger 36, the present invention permits injector drive train wear to be compensated for by changes in the length of the hydraulic link formed in timing chamber 52 thereby creating a hold down force which is independent from, and unaffected by, injector plunger and drive train wear.

Preferably, 800–1,000 pounds of force, and no less than 600 pounds of force must be applied to the inner plunger to maintain the inner plunger against its seat with sufficient force necessary to prevent secondary injections and exhaust gas blow by into the injector. In order to develop at least 800 pounds of hold down force with, in this case, a 13 mm upper plunger diameter, 4,000 psi must be maintained in timing chamber 52. However, leakage of timing fluid from the timing chamber, i.e. between the plungers and the bore, and through the timing drain passage 70, results in a gradual decrease in the pressure in timing chamber 52 and thus the hold down force. The present invention uses spill regulator valve 18 to minimize and control the leakage, and cam 14 to compensate for leakage from the timing chamber 52, so as to maintain timing fluid in the timing chamber at approximately 4,000 psi throughout the hold down period thereby permitting a sufficient hold down force to be applied to the inner plunger.

Spill regulator valve 18 is designed to open at approximately 4,000 psi corresponding to approximately the desired 1,000 pound hold down force. Spill regulator valve 18 includes a pressure actuator band-shaped resilient member 104 positioned around outer barrel 22 so as to cover drain passages 70. Normally, band-shaped resilient member 104 sealingly engages outer barrel 22 so as to block the flow of timing fluid from timing chamber 52. However, when a predetermined maximum pressure is reached in timing chamber 52, i.e. 4,000 psi, band-shaped resilient member 104 flexes so as to uncover drain passages 70 allowing timing fluid to flow from timing chamber 52 through axial passage 64, radial passage 66, annular groove 68 and drain passages 70 to a low pressure drain. Preferably, timing spill regulator valve 18 is of the type of valve disclosed in U.S. Pat. No. 5,275,337 issued to Kolarik et al., and commonly assigned to the assignee of the present application, which is hereby incorporated by reference.

Figure 2:
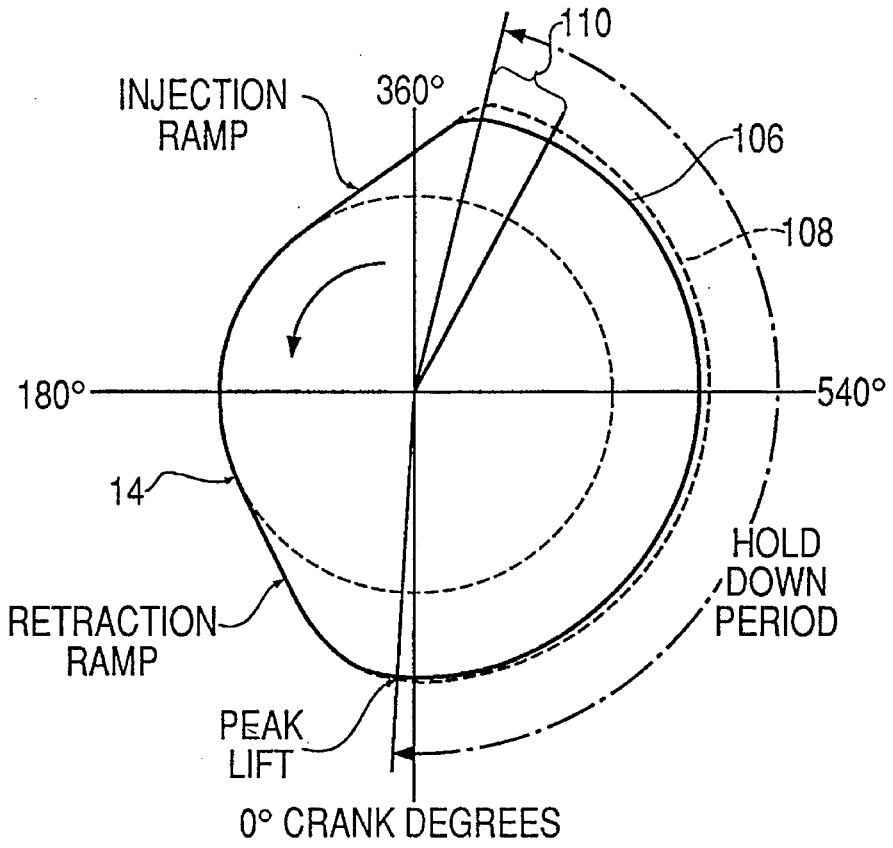
FIG. 2 is a diagrammatic illustration of the cam of the present invention having a hold down ramp portion for moving the outer injector plunger inwardly throughout a substantial portion of the hold down period.
Figure 3A:
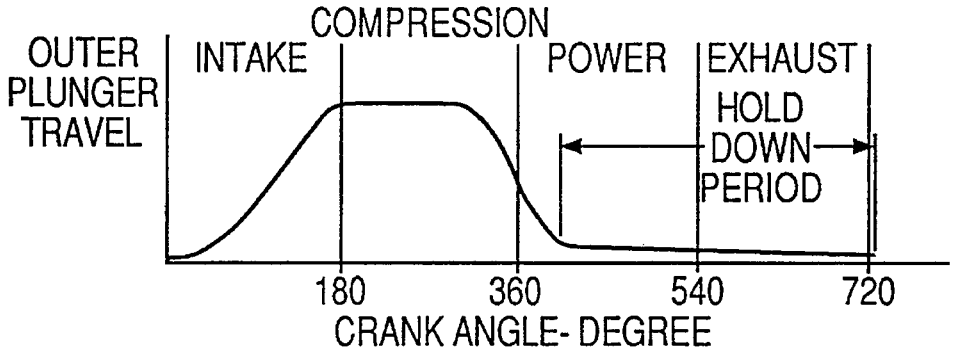
FIG. 3A is a graph illustrating movement of the outer plunger of the open nozzle fuel injector assembly of the present invention throughout an entire engine cycle.
Figure 4:
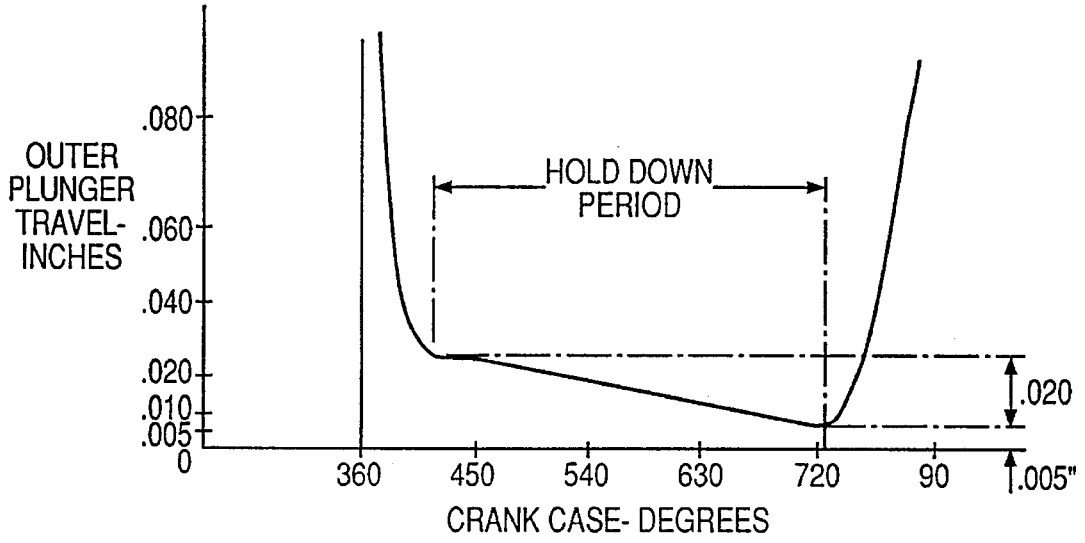
FIG. 4 is an exploded view of a portion of the graph of FIG. 3A showing the inward travel of the outer plunger during the hold down period.
Figure 5:
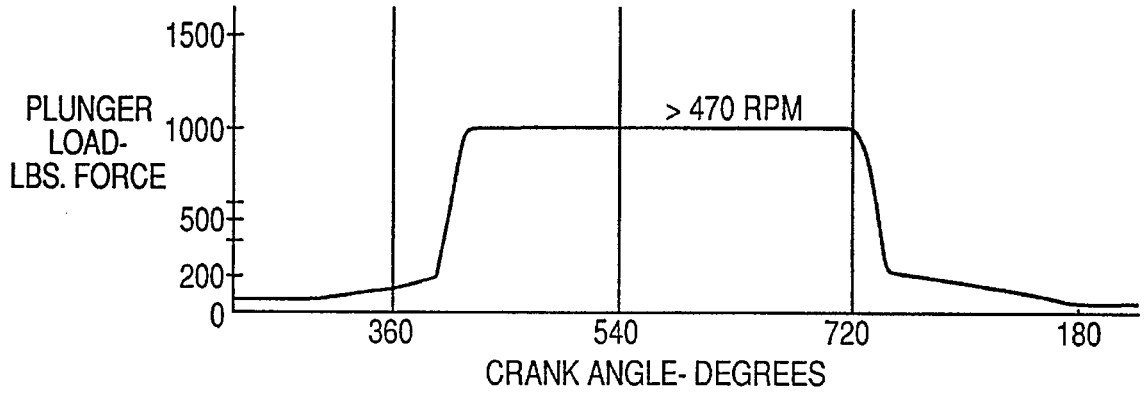
FIG. 5 is a graph of a portion of the engine cycle showing the load applied by the drive train of the present invention on the inner plunger during the hold down period.

The present invention also utilizes a specially designed cam 14 having a cam profile with a hold down cam or ramp portion 106. Hold down cam portion 106, as shown in FIGS. 1 and 2, is ramped so that as cam 14 rotates the diameter of the outer base circle increases thus gradually pivoting rocker arm 90 and moving outer plunger 32 inwardly toward intermediate plunger 34. Thus, as timing fluid leaks from timing chamber 52 through clearances between the plungers and their respective cavities, and through timing spill regulator valve 18, hold down cam or ramp portion 106 insures that outer plunger 32 compensates for such leakage by continuing to compress the timing fluid in timing chamber 52. In this manner, cam 14, in conjunction with spill regulator valve 18 ensures the proper hold down forces applied throughout the hold down period until after the engine exhaust valves are closed, as shown in FIGS. 3A and 4.

Timing spill regulator valve 18 is designed to control the amount of leakage so as to permit the total leakage from timing chamber 52 to be approximated. The worst leakage rate can be calculated to be approximately 0.038 $in^3$/second including leakage through both the timing spill regulator valve 18 and the clearances between the plungers and their respective bores which includes dilation effects due to the high pressure of the fuel on the outer barrel 22. Of course, the leakage rate will vary depending on the sealing ability of the spill regulator valve, the desired operating fluid pressure in the timing chamber, the diameter of the plunger bore, plunger/bore clearances, seal lengths, etc. In turn, the taper of the hold down cam portion is directly dependent on the amount of leakage so that the greater the leakage from the timing chamber during the hold down period, the larger the ramp or taper required on the hold down ramp portion to move the outer plunger an axial distance necessary to compensate for the fluid loss while maintaining the desired hold down force, and vice versa. In the preferred embodiment, at 500 rpm, 0.038 $in^3$/sec of fluid leakage and a hold down ramp length of 304°, the total quantity leaked per hold down period is approximately 63 $mm^3$. In order to compensate for this leakage while maintaining approximately 1,000 lbs hold down force, a hold down ramp 106 capable of moving outer plunger 32 inwardly 0.02 inches during the hold down period is required. Assuming a 0.02 inch ramp portion and a 13 mm diameter outer plunger, the total volume of timing fluid in the timing chamber available for leakage during each hold down period is 67 $mm^3$. In fact, a hold down force of approximately 1,000 lbs would be maintained at speeds of at least 470 rpm. Since most engines operate above at least 470 rpm, the 0.02 inches outer base ramp, in combination with a 13 mm diameter plunger, is large enough to insure fluid remains in timing chamber 52 at normal engine operating speeds. At engine speeds below 470 rpm, the hold down force would decrease as the pumping effect of the outer plunger 32 could not compensate for the total leakage. At speeds above 470 rpm, outer plunger 32 functions similar to a pump to maintain pressure in the timing chamber by moving inwardly at a sufficient rate dictated by a hold down cam portion 106 such as to maintain a desired fluid pressure in timing chamber 52 corresponding to the desired hold down force.

Figure 3B:
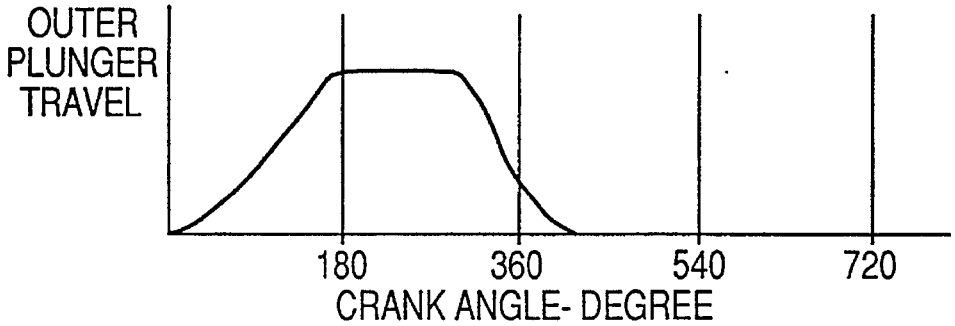
FIG. 3B is a graph illustrating movement of an outer plunger of a conventional open nozzle injector assembly throughout an engine cycle.

As shown in FIGS. 2 and 3B, a conventional cam includes a hold down portion represented by dashed line 108, having a substantially constant outer diameter. Conventional hold down cam portion 108 merely holds the outer plunger in abutment against the intermediate plunger throughout the hold down period so as to hold the inner plunger against its seat. However, as discussed hereinabove, as the injector drive train wears throughout its operation, the hold down force undesirably decreases requiring resetting procedures. As shown in FIGS. 2 and 3A, hold down cam portion 106 of cam 14 of the present invention, in conjunction with timing spill regulating valve 18, keeps outer plunger 32 moving inwardly to compensate for leakage from timing fluid chamber 52 without outer plunger 32 contacting intermediate plunger 34 during the entire hold down period. As shown in FIGS. 3A and 4, the outer plunger travels or moves approximately 0.02 inches during the hold down period toward intermediate plunger 34 while, as shown in FIG. 3B, a conventional cam causes a conventional open nozzle injector outer plunger to bottom out against an intermediate or inner plunger soon after the end of injection. As shown in FIGS. 2 and 4, the present cam does include a small flat portion 110 covering approximately 15° of the cam profile which may momentarily stop the inward movement of outer plunger 32. However, this 15° flat is not necessary to the proper operation of the present invention and may be omitted. The flat is merely used as one way of incorporating a reference point used in installing and setting the drive train and injector assembly. Therefore, as shown in FIG. 4, cam 14 operates to maintain the appropriate timing fluid pressure in timing chamber 52 by moving outer plunger 32 inwardly throughout a substantial portion of the hold down period.

Figure 6A:
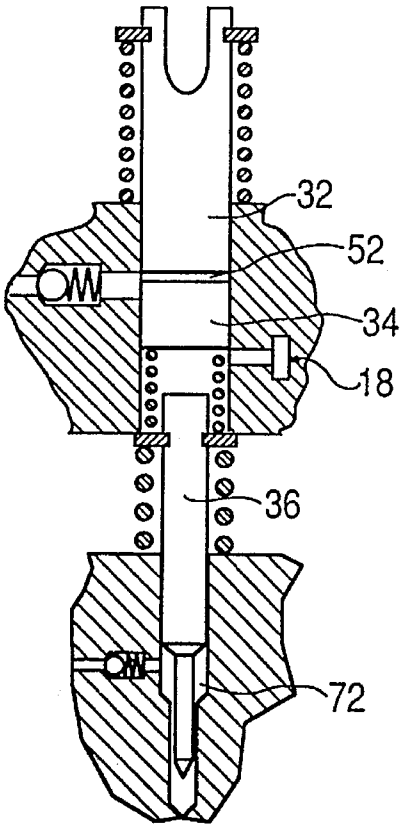
FIGS. 6A–6D is a general schematic of an open nozzle injector of the present invention similar to that shown in FIG. 1, illustrated in various phases of operation.
Figure 6B:
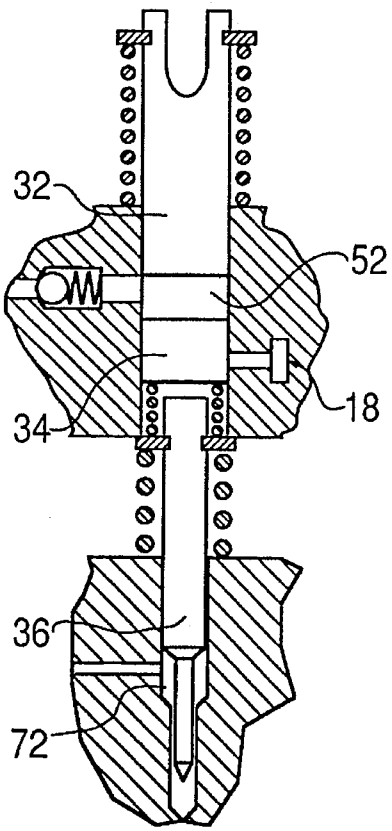
Figure 6C:
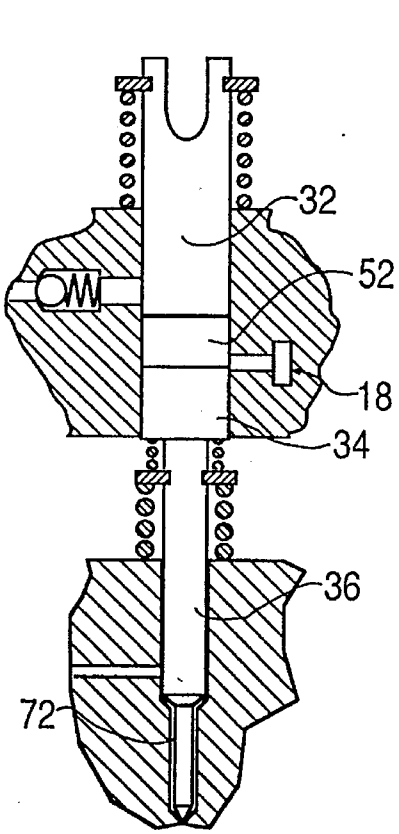
Figure 6D:
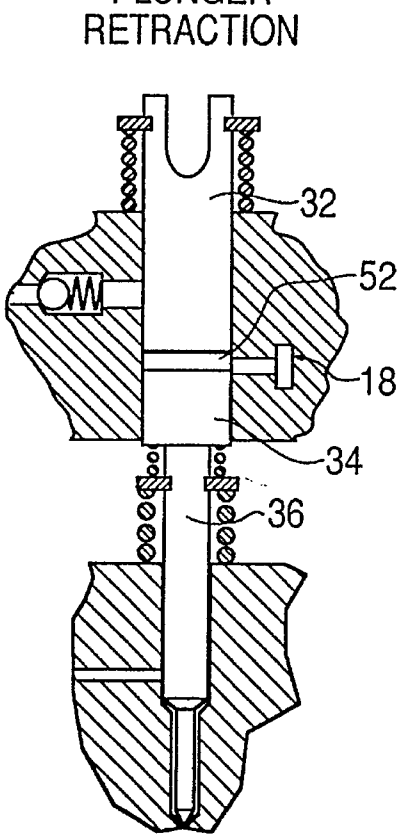

The operation of injector 12 will now be discussed with reference to FIGS. 2 and 6A–6D. As shown in FIG. 6A, with push rod 98 riding on the inner base circle of cam 14, and outer plunger 32, intermediate plunger 34 and inner plunger 36 approaching or in their outermost positions, metering of timing fluid and injection fuel begins. Once the proper amount of timing fluid and injection fuel is metered into the respective chambers, as shown in FIG. 6B, cam 14 continues to rotate so as to drive the plungers inwardly causing injection. As cam 14 continues to rotate, inner plunger 36 bottoms out against its seat in injector cup 26 as timing chamber 52 connects to drain passages 70, as shown in FIG. 6C. As cam 14 continues to rotate, hold down cam portion 106 forces outer plunger 32 against the timing fluid in timing chamber 52. As fluid leaks from timing chamber 52 through timing spill regulator valve 18 and between the plunger and plunger cavity clearances, hold down cam portion 106 moves outer plunger 32 inwardly at a rate necessary to make up for the leaking fuel so as to maintain the pressure in timing chamber 52 at a level sufficient to provide a desired hold down force. At the end of the hold down period as shown in FIG. 6D, upon the beginning of retraction of outer plunger 32, timing fluid remains in timing chamber 52 so as to prevent contact between outer plunger 32 and intermediate plunger 34. Throughout injector operation, as wear occurs at various connections of the injector plungers and injector drive train 16, such as connections 94, 100 and 102, the final amount of timing fluid remaining in timing chamber 52 at the end of the hold down period will increase corresponding to the amount of wear causing an increase in the axial length of the hydraulic link in timing chamber 52. Thus the wear in the drive train is directly compensated for by an automatic corresponding increase in the amount of fluid in the timing chamber. Moreover, the gradual increase in the length of the hydraulic link due to train wear has no effect on the hold down force since the hold down force generating device of the present invention operates independently of drive train wear to maintain the fluid pressure in the timing chamber necessary to maintain a sufficient hold down force on inner plunger 36.

INDUSTRIAL APPLICABILITY

The fuel injector and drive train assembly of the present invention finds particular applicability in a large variety of internal combustion engines of varying horse power which use open nozzle cam operated unit fuel injectors having a variable volume timing chamber.

We claim:

1. A cam-operated open nozzle fuel injector for injecting fuel into a combustion chamber of an internal combustion engine, comprising:

an injector body containing a central bore and an injector orifice at an inner end of the injector body;

a reciprocating plunger assembly including an outer plunger and an inner plunger mounted within the central bore and a variable volume timing chamber located between said outer plunger and the inner end of the injector body;

a cam means operatively connected to said reciprocating plunger assembly for imparting inward movement to said inner and outer plungers, said cam means including a hold down cam portion for maintaining said inner plunger in an innermost position against the inner end of said injector body to define a hold down period, wherein said hold down cam portion operates to move said outer plunger inwardly toward said inner plunger throughout a substantial portion of said hold down period.

2. The injector of claim 1, wherein said timing chamber communicates for a portion of each injector cycle with a source of timing fluid, further including a timing chamber drain passage communicating with said timing chamber for draining fluid from said timing chamber and a timing chamber drain regulator valve means for controlling the drainage of fluid through said drain passage from said timing chamber.

3. The injector of claim 2, wherein said hold down cam portion compensates for the controlled fuel drainage by said timing chamber drain regulator valve so as to maintain a predetermined hold down force on said inner plunger.

4. The injector of claim 3, wherein said timing chamber drain regulator valve includes a pressure actuated valve means for opening and closing said drain passage in response to a fluid pressure in said timing chamber.

5. The injector of claim 4, wherein said pressure actuated valve means includes a band-shaped resilient valve member.

6. The injector of claim 1, wherein said reciprocating plunger assembly further includes an intermediate plunger mounted for reciprocating movement within said central bore between said outer and inner plungers to form said timing chamber between said outer and said intermediate plungers.

7. The injector of claim 6, further including a variable volume injection chamber formed between said inner plunger and the inner end of the injector body for receiving fuel for injection.

8. The injector of claim 1, further including a rocker arm operatively connecting said cam means to said outer plunger and a push rod operatively connecting said cam means to said rocker arm.

9. A cam-operated open nozzle fuel injector for injecting fuel during successive injection cycles into a combustion chamber of an internal combustion engine, comprising:

an injector body containing a central bore and an injector orifice at an inner end of the injector body;

a reciprocating plunger assembly including an outer plunger and an inner plunger mounted within the central bore and movable between advanced and retracted positions, a variable volume injection chamber being defined between said inner plunger and the inner end of the injector body and a variable volume timing chamber located between said outer plunger and said inner plunger, said timing chamber communicating for a portion of each injector cycle with a source of timing fluid;

a hold down force generating means for creating a hold down force on said inner plunger tending to hold said inner plunger in its advanced position against said inner end following termination of injection during each injection cycle to define a hold down period between the termination of injection and the beginning of retraction of said inner plunger toward said retracted position, said hold down force generating means capable of maintaining timing fluid in said timing chamber throughout said hold down period so as to create a hydraulic hold down link between said outer and said inner plungers, said hydraulic hold down link being maintained throughout said hold down period.

10. The injector of claim 8, wherein said hydraulic link has a minimal size upon completion of said hold down period, further including an injector drive train for moving said reciprocating plunger assembly between said advanced and said retracted positions, said injector drive train and said reciprocating plunger assembly subject to drive wear during injector operation tending to increase said minimal size of said hold down link, said hold down force generating means capable of maintaining said hold down force at a predetermined level throughout injector operation.

11. The injector of claim 8, said hold down force generating means including a cam means operatively connected to said reciprocating plunger assembly for imparting inward movement to said outer and inner plungers, said cam means including a hold down cam portion for maintaining said inner plunger in said advanced position.

12. The injector of claim 10, wherein said hold down cam portion operates to move said outer plunger inwardly toward said inner plunger throughout a substantial portion of said hold down period.

13. The injector of claim 8, further including a timing chamber drain passage communicating with said timing chamber for draining fluid from said timing chamber, said hold down force generating means further including a timing chamber drain regulator valve means for controlling the drainage of timing fluid through said drain passage from said timing chamber.

14. The injector of claim 10, further including a timing chamber drain passage communicating with said timing chamber for draining fluid from said timing chamber, said hold down force generating means further including a timing chamber drain regulator valve means for controlling the drainage of timing fluid through said drain passage from said timing chamber.

15. The injector of claim 14, wherein said timing chamber drain regulator valve includes a pressure actuated valve means for opening and closing said drain passage in response to a fluid pressure in said timing chamber.

16. The injector of claim 15, wherein said pressure actuated valve means includes a band-shaped resilient valve member.

17. The injector of claim 9, wherein said reciprocating plunger assembly further includes an intermediate plunger mounted for reciprocating movement within said central bore between said outer and inner plungers to form said timing chamber between said outer and said intermediate plungers.

18. The injector of claim 17, further including a variable volume injection chamber formed between said inner plunger and the inner end of the injector body for receiving fuel for injection.

19. The injector of claim 10, further including a rocker arm operatively connecting said cam means to said outer plunger.

20. The injector of claim 17, further including a push rod operatively connecting said cam means to said rocker arm.

* * * * *